US009020707B2

(12) United States Patent
Imura et al.

(10) Patent No.: US 9,020,707 B2
(45) Date of Patent: Apr. 28, 2015

(54) CONSTRUCTION MACHINE HAVING SWING BODY

(75) Inventors: Shinya Imura, Toride (JP); Seiji Ishida, Hitachinaka (JP); Kouji Ishikawa, Kasumigaura (JP); Yusuke Kajita, Ushiku (JP); Hidetoshi Satake, Ishioka (JP); Takatoshi Ooki, Kasumigaura (JP); Manabu Edamura, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 43 days.

(21) Appl. No.: 13/877,716

(22) PCT Filed: Oct. 5, 2011

(86) PCT No.: PCT/JP2011/072996

§ 371 (c)(1),
(2), (4) Date: Apr. 15, 2013

(87) PCT Pub. No.: WO2012/050028

PCT Pub. Date: Apr. 19, 2012

(65) Prior Publication Data

US 2013/0195597 A1 Aug. 1, 2013

(30) Foreign Application Priority Data

Oct. 14, 2010 (JP) ..... 2010-231080

(51) Int. Cl.

| | |
|---|---|
| ***E02F 9/20*** | (2006.01) |
| ***E02F 9/22*** | (2006.01) |
| ***E02F 9/12*** | (2006.01) |

(52) U.S. Cl.

CPC ..... *E02F 9/2025* (2013.01); *E02F 9/2217* (2013.01); *E02F 9/2058* (2013.01); *E02F 9/123* (2013.01); *E02F 9/2075* (2013.01); *E02F 9/2095* (2013.01); *E02F 9/2285* (2013.01); *E02F 9/2296* (2013.01)

(58) Field of Classification Search

CPC ..... E02F 9/2058; E02F 9/2062; E02F 9/2075; E02F 9/2217; E02F 9/123; E02F 9/2296

USPC ..... 701/22, 36, 50; 180/65.21, 65.27

See application file for complete search history.

(56) References Cited

U.S. PATENT DOCUMENTS

2011/0029175 A1* 2/2011 Kang et al. ..... 701/22

FOREIGN PATENT DOCUMENTS

| | | |
|---|---|---|
| JP | 2001-16704 | 1/2001 |
| JP | 2004-124381 | 4/2004 |
| JP | 2008-63888 | 3/2008 |
| JP | 2008-291522 | 12/2008 |

* cited by examiner

*Primary Examiner* — Thomas Tarcza
*Assistant Examiner* — Kevin Myhre
(74) *Attorney, Agent, or Firm* — Baker Botts, LLP

(57) ABSTRACT

Disclosed is a hybrid-type construction machine equipped with a swing hydraulic motor 27 and a swing electric motor 25 in combination to save energy, the construction machine ensuring high operability of a swing body 20 and providing high energy efficiency. In accordance with the amount of manipulation of a swing control lever 72, the construction machine changes a rate of a torque of the swing electric motor 25 with respect to that of the swing hydraulic motor 27. The construction machine also controls a relief pressure and the torque of the swing electric motor 25 in accordance with the amount of manipulation of a swing control lever 72, a pressure of the swing hydraulic motor 27, and a rotating speed of the swing electric motor 25.

8 Claims, 12 Drawing Sheets

CONSTRUCTION MACHINE HAVING SWING BODY

TECHNICAL FIELD

The present invention relates to a construction machine having a swing body, such as a hydraulic excavator.

BACKGROUND ART

Hydraulic excavators and other construction machines are powered by gasoline, light gas oil, or other fuels, and drive a hydraulic motor, a hydraulic cylinder, or other hydraulic actuators by activating a hydraulic pump via an engine and generating an oil pressure. Hydraulic actuators are compact and lightweight, have high output capacities, and are therefore widely used as the actuators of construction machines.

Meanwhile, as described in Patent Document 1, construction machines using an electric motor to drive electric actuators and save energy by enhancing energy efficiency in comparison with a construction machine that uses only the hydraulic actuators driven by the hydraulic energy of a hydraulic pump, have been proposed in recent years.

Hydraulic actuators regenerate motive energy by storing kinetic energy into an accumulator provided on a hydraulic circuit, or by converting an oil pressure into electricity, whereas electric actuators regenerate electrical energy directly from the kinetic energy obtained during braking. Electric actuators are therefore superior to hydraulic actuators in terms of energy utilization efficiency.

The conventional technique presented in Patent Document 1, for example, employs a hydraulic excavator including an electric motor mounted thereupon as an actuator to drive a swing body. The actuator that swings an upper structure of the hydraulic excavator over a lower structure is used very frequently during work and frequently repeats acceleration and deceleration.

For example, during soil excavation for loading onto a dump truck, after a bucket has been filled with the excavated soil, the hydraulic excavator first turns around and accelerates towards the dump truck. Next in front of the dump truck, the excavator turns around once again, decelerates, and dumps the soil onto a rear body of the dump truck directly from above. After this, the excavator turns around one more time and accelerates towards the location of excavation. Next in front of the location of excavation, the excavator turns around, decelerates, and stops there for further excavation. These steps are repeated.

During this work, if no regenerative operation occurs in hydraulic fashion, then in a case of a hydraulic motor, kinetic energy of the swing body having a heavy inertial load under decelerating conditions, or braking conditions, is given away as heat from the hydraulic circuit since a hydraulic fluid returns to a tank in accordance with a pressure setting of a relief valve.

In a case of an electric motor, on the other hand, since the swing body having the heavy inertial load causes the electric motor to function as an electric power generator, output energy from the electric motor can be regenerated as electrical energy. It is considered from this fact that in terms of energy saving, it is effective to use an electric motor instead of a hydraulic motor.

Using an electric motor to swing an upper structure of a construction machine, however, poses the following problems due to characteristics of the electric motor.

First, maintaining the swing body in a stopped state using the electric motor requires conducting speed feedback control based upon a control variable determined from a comparison between an actual speed and a target control speed. Speed feedback control, however, easily causes hunting due to impacts of a time delay. In addition, during electric motor driving, since an operational feeling is determined by control, particular control performance may cause a feeling of operational discomfort or uneasiness. Furthermore, electric motor or inverter overheating may occur when the electric motor is not rotating and torque is continuously output, for example during ditching when a boom, an arm, and a bucket are shaken/swung to excavate a ditch with the swing body being actuated in jog mode and a side face of the bucket being kept pressed against an inner side face of the ditch. Moreover, use of an electric motor guaranteed to develop an output equivalent to that of a hydraulic motor may pose a problem of motor oversizing or a significant increase in cost.

In order to solve the above problems, Patent Documents 2 and 3 disclose construction machines adapted to realize energy saving and to include both of a hydraulic motor and an electric motor and drive or brake a swing body by use of a total torque of the motors.

The conventional technique disclosed in Patent Document 2 employs an energy-regenerating device of a hydraulic construction machine in which an electric motor for swinging is directly coupled to a hydraulic motor for swinging and a controller sends an output torque command to the electric motor in accordance with the amount of manipulation of a control lever for swinging. During deceleration, that is, during braking, the electric motor in the conventional technique regenerates kinetic energy of the swing body and stores the energy into a battery as electrical energy.

The conventional technique disclosed in Patent Document 3 employs a hybrid-type construction machine that uses a differential pressure between a meter-in circuit and meter-out circuit of a hydraulic motor to calculate a torque command value to be assigned to an electric motor, for adequate output torque allocations between the hydraulic motor and the electric motor.

Both of the conventional techniques disclosed in Patent Documents 2 and 3 use a hydraulic motor and an electric motor in combination as actuators for swinging. Both techniques, therefore, ensure a sufficient torque necessary to drive the swing body, and recover electrical energy with the electric motor. Both also save energy by adopting a simplified and easy-to-commercialize system configuration as the swing body driving system in the construction machine.

PRIOR ART DOCUMENTS

Patent Documents

Patent Document 1: Japanese Patent No. 3647319
Patent Document 2: Japanese Patent No. 4024120
Patent Document 3: JP-2008-63888-A

SUMMARY OF THE INVENTION

Problems to be Solved by the Invention

The following problems, however, exist with the above conventional techniques.

For example, in the conventional technique described in Patent Document 2, it is disclosed that the torque command value to be assigned to the swing electric motor is calculated in accordance with the amount of manipulation of the swing control lever. The description in Patent Document 2, however, does not allow for changes in the torque of the swing hydraulic motor due to an orientation of a front section including the bucket, boom, and arm of the construction machine, an actual quantity of materials loaded, an inclination of a road surface on which the construction machine is working, and other related effects.

For this reason, the total torque of the swing hydraulic motor torque and the swing electric motor torque to be output in accordance with the torque command value to the swing electric motor may not be a desired torque that matches the amount of manipulation of the swing control lever.

In addition, in the conventional technique described in Patent Document 3, the calculation of the torque command value for the electric motor is based upon the differential pressure developed between two ports, one an oil suction port and one an oil delivery port, that are mounted in the hydraulic motor. The fact that the torque of the hydraulic motor changes according to the particular amount of manipulation of the swing control lever, however, is not considered and a rate of the hydraulic motor torque and the electric motor torque is controlled to be constant, regardless of the amount of manipulation of the swing control lever. The desired torque matching the amount of manipulation of the swing control lever, therefore, is not likely to be obtainable considering the torque of the hydraulic motor that changes in accordance with the amount of manipulation of the swing control lever.

An object of the present invention is therefore to provide a hybrid-type construction machine ensuring high operability of a swing body and having high energy efficiency.

Means for Solving the Problems

In order to attain the above object, a construction machine according to an aspect of the present invention comprises: a swing hydraulic motor driven by an oil pressure that a hydraulic pump generates when driven by an engine; a swing electric motor connected to the swing hydraulic motor and driven by electric power that an electricity storage device supplies; and a swing body connected to the swing electric motor, with the machine braking/driving the swing electric motor and the swing hydraulic motor according to a manipulation stroke of a swing control lever which operates the swing body, and thereby braking/driving the swing body by use of a total torque of the swing electric motor and the swing hydraulic motor; wherein an electric motor torque command value that is input to the swing electric motor to brake/drive the swing electric motor is calculated by multiplying a torque of the swing hydraulic motor by a gain which is set according to the manipulation stroke of the swing control lever.

Effects of the Invention

In accordance with the present invention, a hybrid-type construction machine with a swing body provides high operability of the swing body and achieves high energy efficiency.

MODE FOR CARRYING OUT THE INVENTION

As described earlier herein, when the torque command value to be assigned to the swing electric motor is calculated, since no consideration is given to the changes in swing hydraulic motor torque due to the orientation of the front section, the working environment of the construction machine, the amount of manipulation of the swing control lever, and/or other parameters, the desired torque matching the amount of manipulation of the swing control lever may not be obtainable for the swing body. If this is the case, the braking/driving force of the swing body that matches the amount of manipulation of the swing control lever cannot be obtained, which makes an operator feel discomfort or uneasiness during operations.

Accordingly, the present invention discloses a technique for calculating a torque command value for a swing electric motor so that a total torque applied from the swing electric motor as well as a swing hydraulic motor to a swing body will be a torque matching the amount of manipulation of a lever.

The present invention additionally achieves a hybrid-type construction machine in which, even if a torque of a swing electric motor cannot be generated for whatever reason, a hydraulic system guarantees basic performance of an excavator. In the related conventional art, since the swing electric motor undertakes to assign only a constant torque of the total swing torque, if a lack of energy in an electricity storage device, an overdischarge state thereof, electrical faults in an inverter, a motor, or the like, or other trouble occurs and the torque from the swing electric motor cannot be obtained, this is likely to make the desired swing torque unobtainable. The present invention solves this problem by achieving the hybrid-type construction machine in which, even if trouble occurs in the swing electric motor, the hydraulic system guarantees the basic performance of the excavator.

To this end, the present invention provides a construction machine having a composite swing mode using both a swing hydraulic motor and a swing electric motor, and an independent swing mode using only a swing hydraulic motor, and employs a configuration that achieves driving by selectively using each mode. In this configuration, when a swing control lever is not manipulated and when the swing control lever is manipulated through its maximum operable stroke, a swing body is driven in the hydraulic motor independent swing mode. Hereinafter, a state in which the swing control lever is not manipulated is referred to as a neutral state, and a state in which the swing control lever is manipulated through the maximum operable stroke, as a maximum stroke state.

Figure 15:
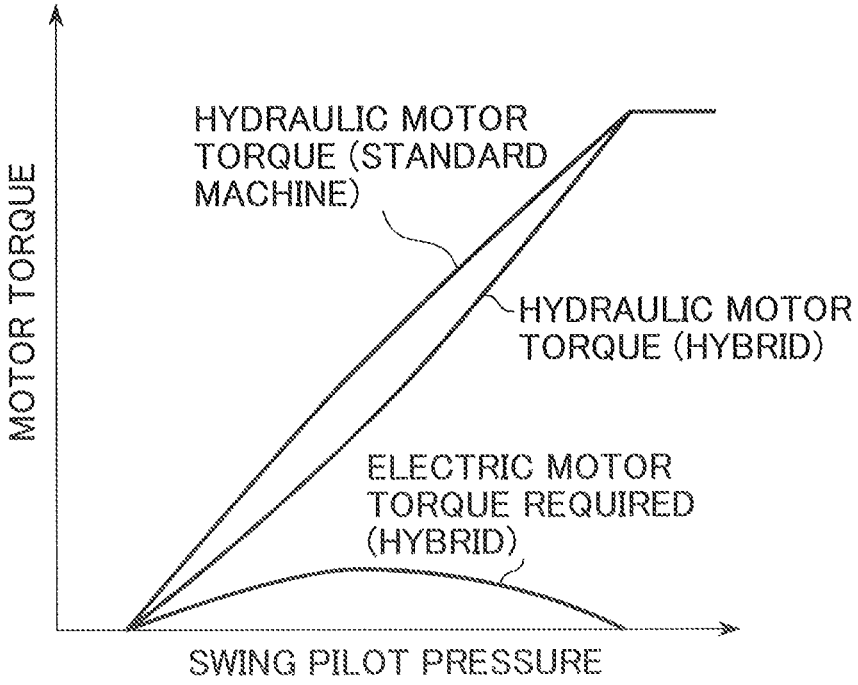
FIG. 15 is an allocation diagram of a swing hydraulic motor torque and swing electric motor torque with respect to a pilot pressure in the second embodiment.

The composite swing mode is defined as a mode in which the swing control lever is set to a position corresponding to a manipulation stroke greater than that of the lever in the neutral state, but smaller than that of the lever in the maximum stroke state. A region in which the swing control lever is set to a manipulation stroke greater than that of the lever in the neutral state, but smaller than that of the lever in the maximum stroke state, is hereinafter referred to as an intermediate region. In the composite swing mode, an allocation rate between a torque of the swing hydraulic motor and that of the swing electric motor is controlled so that as in FIG. 15, for example, the torque of the swing electric motor in the intermediate region is maximized with respect to that of the swing hydraulic motor. This places the machine in energy-saving operation. In this way, configuring the machine so as to have the hydraulic motor independent swing mode and the composite swing mode and selectively use one of these modes, depending upon a desired manipulation stroke of the swing lever, allows energy saving to be implemented by braking/driving the swing electric motor while guaranteeing basic performance of the working machine in the swing hydraulic motor. In particular, configuring the machine so as to be set to the hydraulic motor independent swing mode when the swing control lever is in either the neutral state or the maximum stroke state allows the machine to be started or stopped substantially the same as one in the normal state, irrespective of whether electricity storage device trouble is occurring.

The following describes embodiments of the present invention in detail.

First Embodiment

Figure 1:
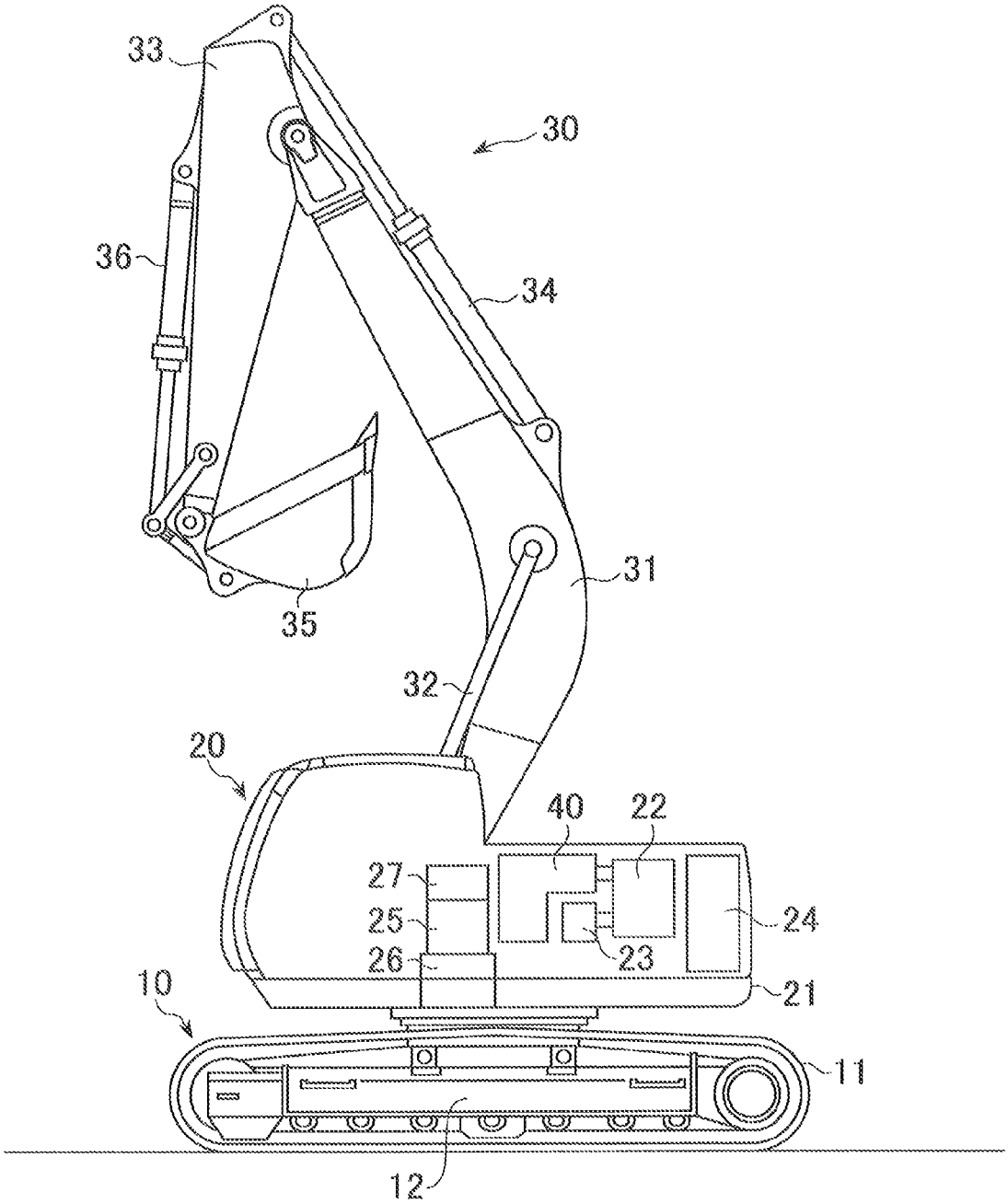
FIG. 1 is a side view of a hydraulic excavator according to the present invention.

A side view of a hydraulic excavator according to a first embodiment is shown in FIG. 1. Referring to FIG. 1, a lower structure 10 includes one pair of crawlers 11 and crawler frames 12, although one side of both of the elements 11 and 12 is only shown in FIG. 1. In addition, the lower structure 10 includes one pair of traveling hydraulic motors 13, 14, not shown in FIG. 1, for independent driving control of each crawler 11. The lower structure 10 further includes a speed reduction mechanism and/or the like.

A swing body 20 consists essentially of a swing frame 21, an engine 22, an assist power-generating motor 23, a swing electric motor 25, a capacitor 24, a swing mechanism 26, a swing hydraulic motor 27, and a speed reduction mechanism not shown. The swing electric motor 25 and the swing hydraulic motor 27 are connected at respective rotating shafts to each other, and the swing electric motor 25 and swing hydraulic motor 27 connected to each other through the rotating shafts brake/drive the swing body 20 via the swing mechanism 26.

The engine 22 is provided above the swing frame 21. The capacitor 24, connected to the assist power-generating motor 23 provided coaxially with the engine 22, is also connected to the swing electric motor 25 provided coaxially with the swing hydraulic motor 27 and the swing mechanism 26. The capacitor 24 becomes charged/discharged by a braking/driving action of the assist power-generating motor 23 and the swing electric motor 25. The swing mechanism 26 swings the swing body 20 and the swing frame 21 with respect to the lower structure. The speed reduction mechanism slows down rotation of the swing electric motor 25.

The swing body 20 also includes part of an excavator mechanism 30. The excavator mechanism 30 is composed essentially of a boom 31, a boom cylinder 32 for driving the boom 31, an arm 33 pivotally and axially supported near a distal end of the boom 31, an arm cylinder 34 for driving the arm 33, a bucket 35 pivotably and axially supported at a distal end of the arm 33, and a bucket cylinder 36 for driving the bucket 35.

A hydraulic system 40 is also mounted above the swing frame 21 of the swing body 20. The hydraulic system 40 includes a hydraulic pump 41 not shown, for driving the traveling hydraulic motors 13, 14 (not shown in FIG. 1), the swing hydraulic motor 27, the boom cylinder 32, the arm cylinder 34, the bucket cylinder 36, and other hydraulic actuators. The hydraulic system 40 further includes a control valve 42 not shown either, for drivingly controlling each actuator. The hydraulic pump is driven by the engine 22.

Figure 2:
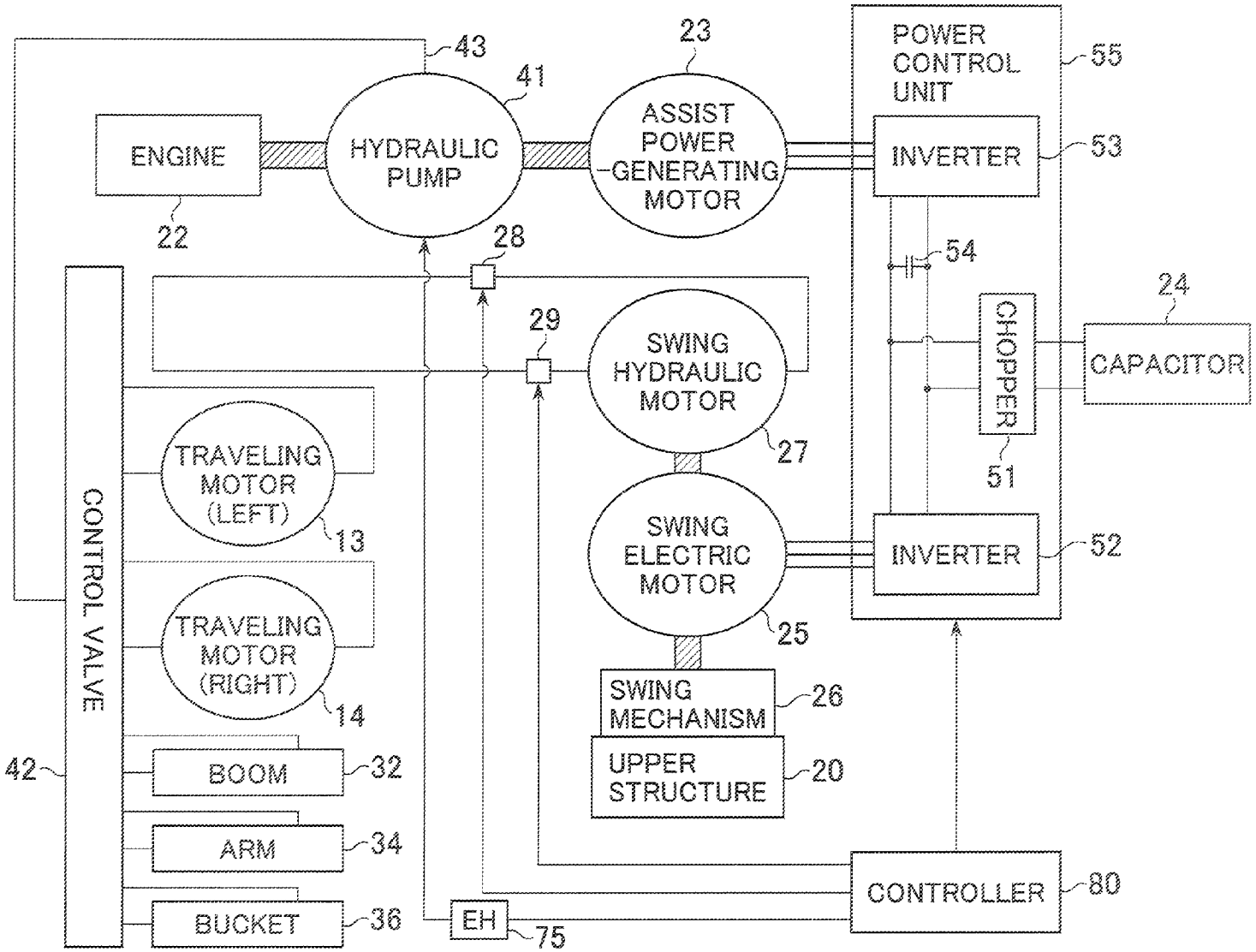
FIG. 2 is a system block diagram of the hydraulic excavator according to the present invention.

A system block diagram of main electric/hydraulic devices in the hydraulic excavator according to the first embodiment is shown in FIG. 2. As shown in FIG. 2, driving force of the engine 22 is transmitted to the hydraulic pump 41. The hydraulic pump 41 delivers a hydraulic fluid to the control valve 42 through a hydraulic line 43. Under manipulation direction and stroke commands from a swing control lever not shown, the control valve 42 upon receiving the hydraulic fluid controls flow rates and flow directions of the hydraulic fluid existing as delivered to the swing hydraulic motor 27, the boom cylinder 32, the arm cylinder 34, the bucket cylinder 36, and the traveling hydraulic motors 13, 14.

The capacitor 24 is connected to a chopper 51, and direct-current (DC) power of the capacitor 24 is boosted to a predetermined bus voltage via the chopper 51. The voltage that has thus been boosted to the predetermined value is input to a swing electric motor inverter 52 for braking/driving the swing electric motor 25, and an assist power-generating motor inverter 53 for braking/driving the assist power-generating motor 23. The assist power-generating motor inverter 53 is connected to the chopper 51 via a smoothing capacitor 54, the smoothing capacitor 54 being provided to stabilize the bus voltage.

Figure 3:
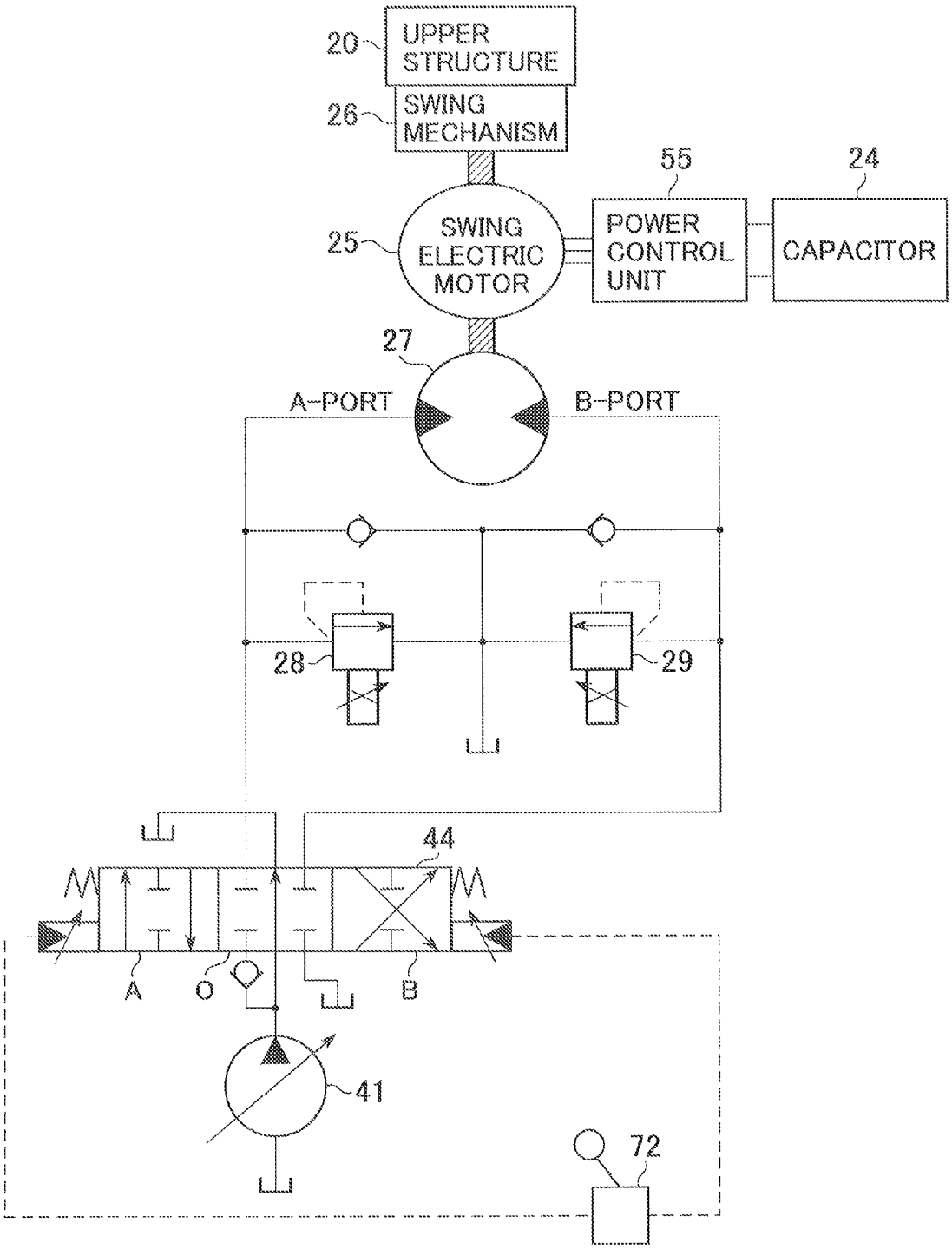
FIG. 3 is a detailed hydraulic system diagram of the hydraulic excavator according to the present invention.

Furthermore, an A-port relief valve 28 and a B-port relief valve 29 are provided at hydraulic fluid inlet and outlet ports of the swing hydraulic motor 27. As shown in FIG. 3, the swing hydraulic motor 27 has two ports serving as the inlet and outlet for the hydraulic fluid. Hereinafter, the port serving as the inlet of the hydraulic fluid during leftward swinging is defined as the A-port, the port serving as the outlet during leftward swinging is defined as the B-port, whereas the port serving as the inlet of the hydraulic fluid during rightward swinging is defined as the B-port, and the port serving as the outlet during rightward swinging is defined as the A-port. The A-port relief valve 28 and the B-port relief valve 29, each formed from a solenoid-operated variable relief valve, control an A-port pressure and B-port pressure, respectively, of the swing hydraulic motor 27.

Although not shown, pressure sensors are provided that independently detect the A-port pressure and the B-port pressure.

A controller 80 uses values not shown, such as the amount of swing control lever manipulation, swing hydraulic motor pressure, and swing hydraulic motor speed, to control the hydraulic pump 41, the A-port relief valve 28, and the B-port relief valve 29. The controller 80 also controls a power control unit 55. An electro-hydraulic signal conversion device 75, configured to receive an electrical signal from the controller 80 and convert this signal into a hydraulic pilot signal, is equivalent to a solenoid-operated proportional valve, for example.

Details of the hydraulic system of the hydraulic excavator according to the first embodiment are shown in FIG. 3.

The swing control lever 72 has a function of a pressure reducing valve to reduce a pressure applied from a pressure source not shown, the reduction depending upon the amount of manipulation of the lever. An operating pressure appropriate for the amount of manipulation of the swing control lever 72 is applied to either of left and right pressure chambers of a swing spool 44 provided inside the control valve 42. The swing spool 44 controls a spool stroke according to the particular operating pressure upon the pressure chamber and thus controls the flow rate of the hydraulic fluid supplied from the hydraulic pump 41 to the swing hydraulic motor 27. The swing spool 44 continuously switches from a neutral position O to an A-position or a B-position, depending upon the operating pressure from the swing control lever 72.

For example, if the swing control lever 72 is in the neutral state and the swing spool 44 is in the neutral position O, the hydraulic fluid that has been delivered from the hydraulic pump 41 returns to a tank through a bleed-off diaphragm.

In contrast, for example if the swing control lever 72 is operated for a leftward swing, the swing spool 44 switches to the A-position and the bleed-off diaphragm decreases in opening area, with the result that meter-in and meter-out diaphragms increasing in opening area. The hydraulic fluid delivered from the hydraulic pump 41 is sent to the A-port of the swing hydraulic motor 27 through the meter-in diaphragm corresponding to the A-position, and the return fluid from the swing hydraulic motor 27 returns to the tank through the meter-out diaphragm corresponding to the A-position. This flow control of the hydraulic fluid rotates the swing hydraulic motor 27 counterclockwise.

Conversely, for example if the swing control lever 72 is operated for a rightward swing, the swing spool 44 switches to the B-position and the bleed-off diaphragm decreases in opening area, with the result that the meter-in and meter-out diaphragms increasing in opening area. The hydraulic fluid delivered from the hydraulic pump 41 is sent to the B-port of the swing hydraulic motor 27 through the meter-in diaphragm corresponding to the B-position, and the return fluid from the swing hydraulic motor 27 returns to the tank through the meter-out diaphragm corresponding to the B-position. This flow control of the hydraulic fluid rotates the swing hydraulic motor 27 clockwise, or in a direction reverse to that of the rotation by switching to the A-position.

When the swing spool 44 is in an intermediate position between the neutral position O and the A-position, the hydraulic fluid that the hydraulic pump 41 has delivered is distributed to the bleed-off diaphragm and the meter-in diaphragm. The same also applies when the swing spool 44 is in an intermediate position between the neutral position O and the B-position.

The A-port relief valve 28 exists between the A-port of the swing hydraulic motor 27 and the swing spool 44, and the B-port relief valve 29 exists between the B-port of the swing hydraulic motor 27 and the swing spool 44. The A-port relief valve 28 and the B-port relief valve 29 are constructed to make the relief pressures at each port side variable in accordance with a command from the controller 80 not shown.

Figure 6:
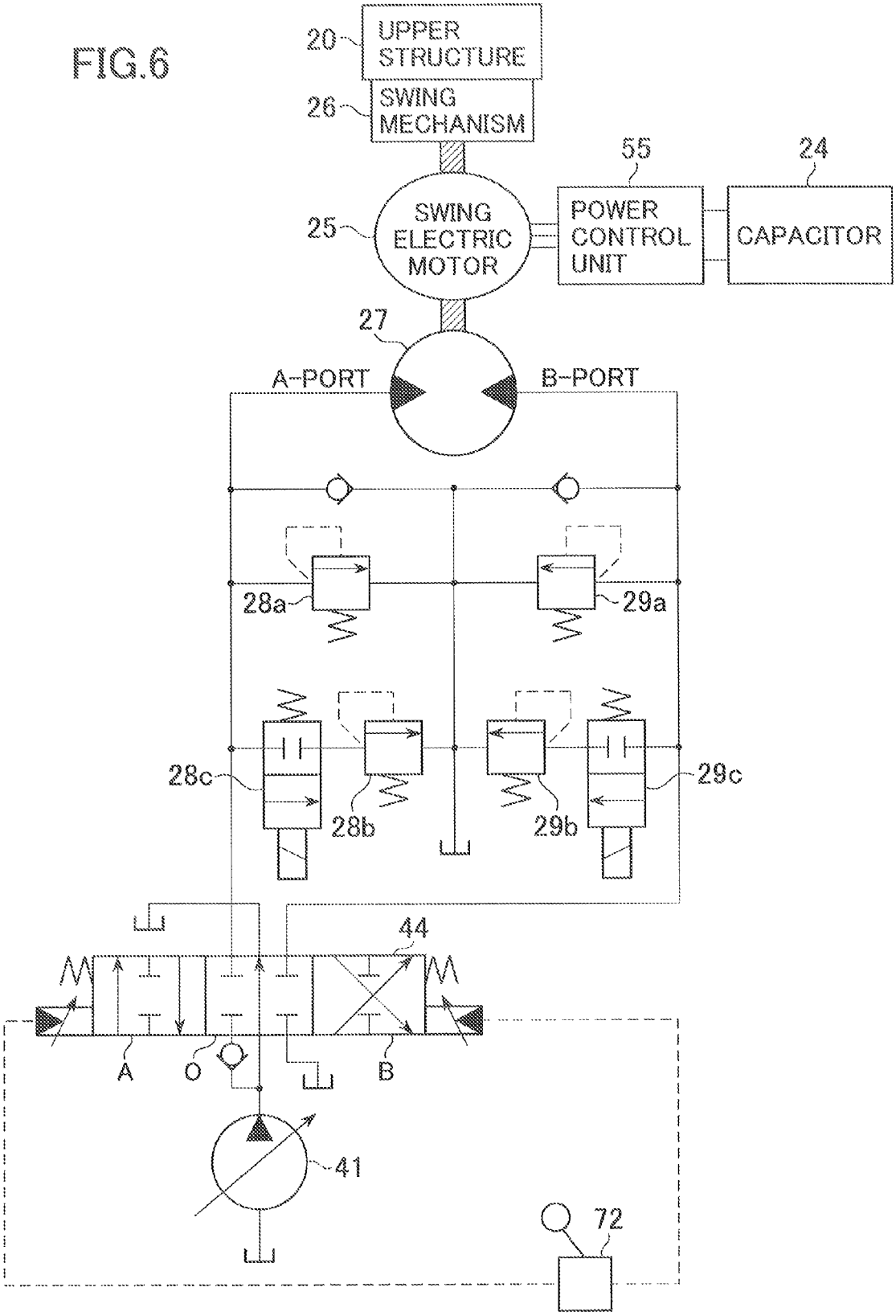
FIG. 6 is a block diagram of a hydraulic system which uses control valves to control a relief pressure of a hydraulic motor in FIG. 3.

While the relief valves 28, 29 have been described as solenoid-operated variable relief valves, relief valves to be used in a hydraulic system configuration shown in FIG. 6 may be switched to a high-pressure side 28*a*, 29*a* and a low-pressure side 28*b*, 29*b*, by control valves 28*c*, 29*c*.

Figure 4:
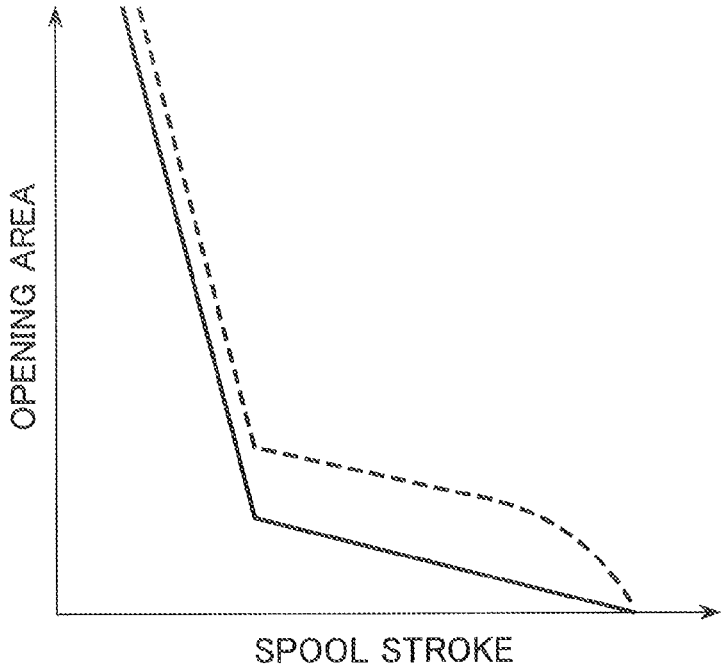
FIG. 4 is a bleed-off opening area diagram of a swing spool.

A bleed-off opening area diagram indicating the bleed-off opening area with respect to the spool stroke of the swing spool 44 in the present embodiment is shown with a dashed line in FIG. 4. The spool stroke here changes according only to the amount of manipulation of the swing control lever, and can therefore be considered to be the swing lever manipulation stroke itself. Along with the bleed-off opening area changes in the present embodiment, a bleed-off opening area of a swing hydraulic motor that enables high operability to be obtained in a conventional construction machine configured to drive a swing body by activating the swing hydraulic motor alone is shown with a solid line in FIG. 4. FIG. 4 indicates that at a starting point and ending point of the diagram, that is, under the neutral state and maximum stroke state of the swing control lever 72, the bleed-off opening area of the swing spool 44 in the present embodiment is set to have substantially the same size as that of the opening area denoted by the solid line. FIG. 4 also indicates that in an intermediate region, the bleed-off opening area of the swing spool 44 in the present embodiment is set to be greater than in the conventional machine.

In this diagram, if the opening area of the bleed-off diaphragm in the swing spool 44 increases, a driving torque obtained in the swing hydraulic motor 27 will decrease. When opening area characteristics similar/equivalent to those of the present embodiment exist, therefore, the driving torque that the swing hydraulic motor 27 will have in the intermediate region of the swing control lever is set to be small, compared with the driving torque generated in the swing spool having the opening area denoted by the solid line. When the swing control lever is in the neutral state and in the maximum stroke state, on the other hand, since the opening area is set to be substantially the same as that denoted by the solid line, the driving torque of the swing hydraulic motor is also substantially of the same magnitude.

Figure 5:
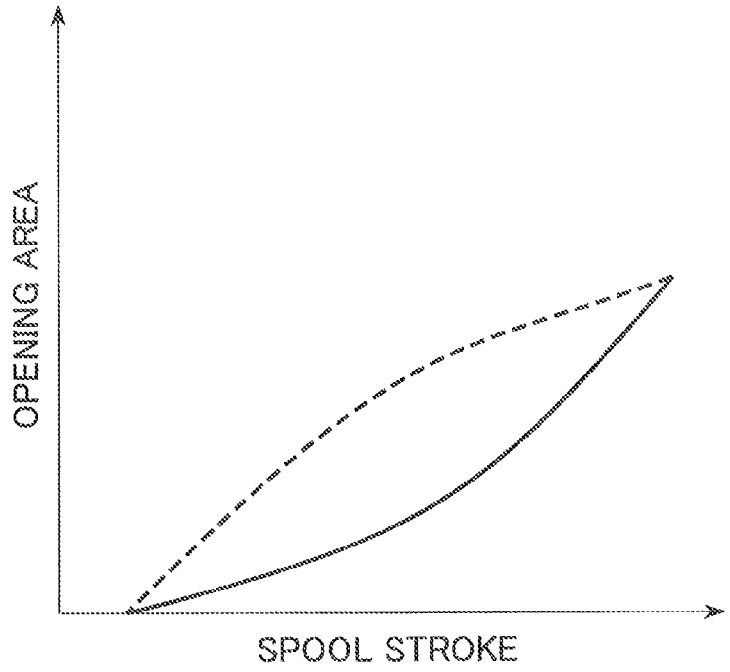
FIG. 5 is a meter-out opening area diagram of the swing spool.

A meter-out opening area diagram indicating the meter-out opening area with respect to the spool stroke of the swing spool 44 in the present embodiment is shown in FIG. 5. As is the case with FIG. 4, since the spool stroke changes according only to the amount of manipulation of the swing control lever, the spool stroke can be considered to be the swing lever manipulation stroke itself. Along with the meter-out opening area changes in the present embodiment, a meter-out opening area of the swing hydraulic motor that enables high operability to be obtained in the above conventional construction machine configured to drive the swing body by activating the swing hydraulic motor alone is shown with a solid line in FIG. 5. FIG. 5 indicates that at a starting point and ending point of the diagram, the meter-out opening area of the swing spool 44 in the present embodiment is set to have substantially the same size as that of the meter-out opening area denoted by the solid line. FIG. 5 also indicates that in the intermediate region, the meter-out opening area of the swing spool 44 in the present embodiment is set to be greater than the opening area denoted by the solid line. As is the case with FIG. 4, since a magnitude of a braking torque depends upon the size of the opening area in the meter-out diaphragm, the braking torque that the swing hydraulic motor 27 will have in the intermediate region of the swing control lever decreases below a braking torque of the swing hydraulic motor in the conventional machine. When the swing control lever is operated to the neutral position and when the lever is operated to the maximum stroke position, since the opening area is set to be substantially the same as that denoted by the solid line, so the braking torque is also substantially of the same magnitude as obtained in the swing hydraulic motor 27.

In this way, the magnitudes of the braking torque and driving torque of the swing hydraulic motor are determined according to the bleed-off opening area and meter-out opening area of the swing spool 44 that are set for the manipulation stroke of the swing control lever.

Figure 7:
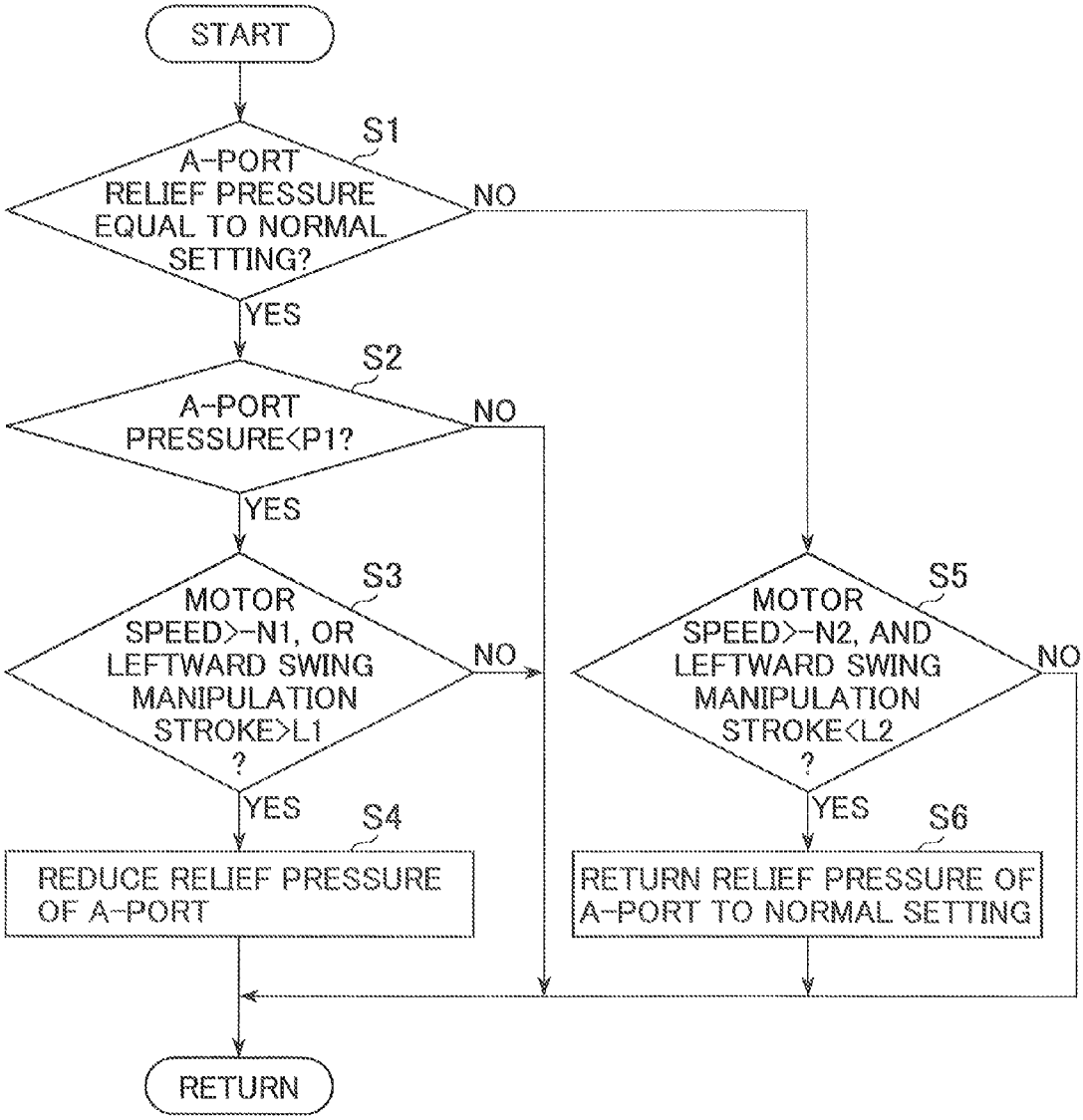
FIG. 7 is a control flow diagram of a relief valve connected to port A.

FIG. 7 is a flow diagram showing a process of controlling the A-port relief valve 28. The control process in FIG. 7 is repeated for each of control periods of the controller 80.

The system of the hydraulic excavator is started. During this start, the A-port is usually set to have a predetermined relief pressure. First, whether the relief pressure of the A-port is the same as the predetermined value is determined in step S1. If the relief pressure is the same as the predetermined value, the process advances to step S2, in which a comparison is then conducted between a current A-port pressure of the swing hydraulic motor 27 and a previously set threshold level P1. If the A-port pressure is lower than the threshold level P1, the process advances to step S3, in which a determination is then conducted to examine either whether the motor speed is lower than a previously set threshold level N1, a positive value, by a factor of minus one (−1), or whether a leftward manipulation stroke of the swing control lever (hereinafter, this manipulation stroke is referred to as the leftward swinging manipulation stroke) is greater than a previously set threshold level L1. If it is determined that the motor speed is lower than the previously set threshold level N1, the positive value, by a factor of minus one (−1), or that the leftward swinging manipulation stroke is greater than the previously set threshold level L1, the relief pressure of the A-port is reduced in step S4. Conversely if it is not determined that the motor speed is lower than the previously set threshold level N1, the positive value, by a factor of minus one (−1), or that the leftward swinging manipulation stroke is greater than the previously set threshold level L1, the process returns to step S1 and whether the relief pressure of the A-port is the same as the predetermined value is determined once again.

If, in step S2, the relief pressure of the A-port is determined to be higher than the threshold level P1, the process once again returns to step S1 and whether the relief pressure of the A-port is the same as the predetermined value is determined.

The description here assumes that the motor speed is defined as a positive speed for a leftward swing or a negative speed for a rightward swing, and that the swing electric motor 25 and the swing hydraulic motor 27 are rotating at the same speed. The description also assumes that the threshold level P1 is set to be lower than a relief pressure level to which the relief pressure of the A-port has been reduced, and that the threshold levels N1 and L1 are values near zero. If the motor speed value is smaller than −N1, the A-port is set to the meter-out side of the swing hydraulic motor 27, or if the leftward swinging manipulation stroke is greater than L1, the A-port is set to the meter-in side of the swing hydraulic motor 27.

If, in step S1, the relief pressure of the A-port is determined not to be the same as the predetermined value, either whether the motor speed is higher than a previously set threshold level N2, a positive value, by a factor of minus one (−1), or whether the leftward swinging manipulation stroke is smaller than a previously set threshold level L2 is determined in step S5. If either of the two conditions is determined to be satisfied, the process advances to step S6, where the relief pressure of the A-port is then returned to the normal setting. If neither of the two conditions is satisfied, the process returns to step S1, in which step, it is then determined once again whether the relief pressure of the A-port is the same as the normal predetermined value. These determinations are conducted assuming that the threshold levels N2 and L2 are values near zero. The threshold level N1 is set to be higher than N2, and the threshold level L1 is set to be higher than L2.

The determination condition in step S2 may be omitted. In other words, the determination result on the A-port pressure may always be positive, or "yes". In addition, the determinations in steps S3 and S5 may use only the motor speed condition and not use the leftward swinging manipulation stroke condition, that is, the relief pressure at the meter-in side may remain unchanged. In this case, in a control process described later herein, the driving torque of the swing electric motor 25 will not easily increase and thus, electrical discharge will not easily occur. Conversely, the determinations in steps S3 and S5 may use only the leftward swinging manipulation stroke condition and not use the motor speed condition, that is, the relief pressure at the meter-out side may remain unchanged. In this case, in the control process described later herein, the braking torque of the swing electric motor 25 will not easily increase and thus, electrical charge will not easily occur.

Furthermore, when the motor speed condition or leftward swinging manipulation stroke condition in step S3 is satisfied, a rate at which the relief pressure is reduced may be changed, that is, a reduction rate of the relief pressure may be changed between the meter-out side and the meter-in side. For example, if the reduction rate of the relief pressure at the meter-out side is increased above that of the meter-in side, then in the control process described later herein, the braking torque of the swing electric motor 25 will easily increase and thus, electrical charge will easily occur.

Figure 8:
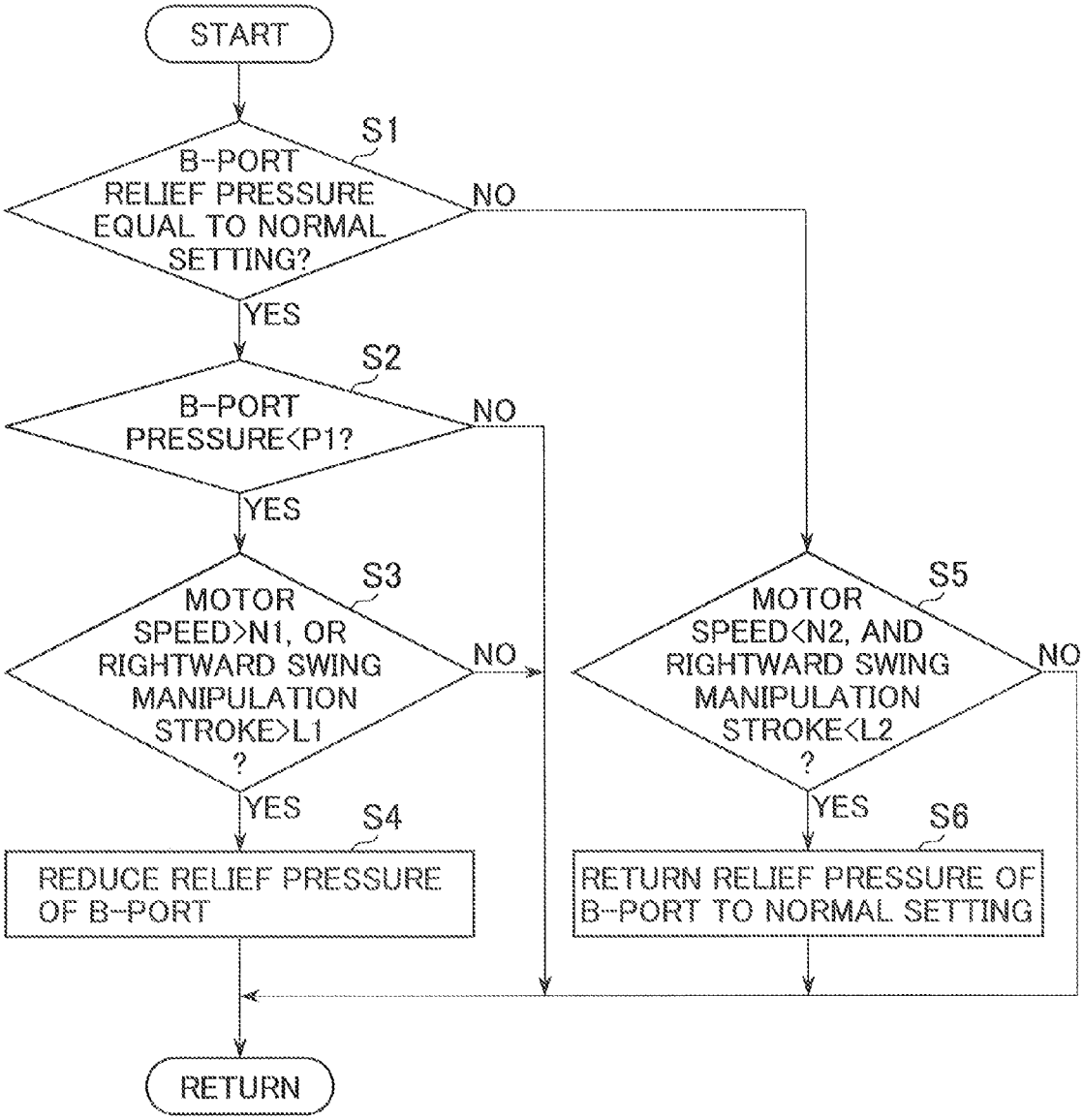
FIG. 8 is a control flow diagram of a relief valve connected to port B.

FIG. 8 is a flow diagram showing a process of controlling the B-port relief valve 29. The control process in FIG. 8 is substantially the same as in FIG. 7, except that the leftward and rightward swinging directions are reversed and that positive and negative values of the motor speed are also correspondingly reversed.

The braking/driving torques of the swing hydraulic motor can be reduced by reducing the relief pressures of the A-port and the B-port in accordance with the control process diagrams shown in FIGS. 7 and 8.

In the present embodiment, the swing hydraulic motor torque has been reduced by setting the opening area of the swing spool and controlling the relief pressures. The construction machine, however, may be configured so that the swing hydraulic motor torque is reduced either by setting the opening area of the swing spool or by controlling the relief pressures.

Figure 9:
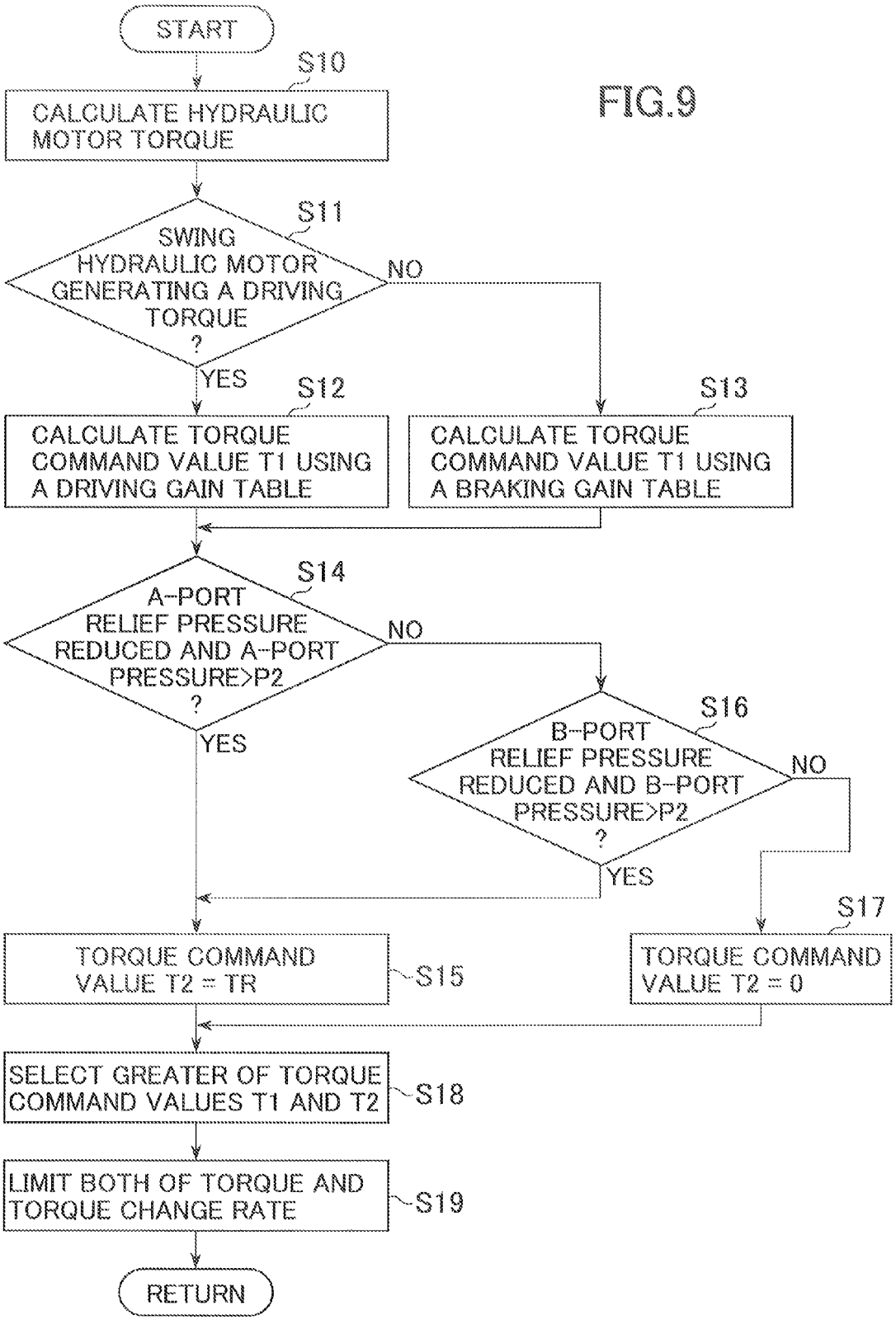
FIG. 9 is a control flow diagram of a swing electric motor.

A process of controlling the swing electric motor is described below. FIG. 9 is a flow diagram showing the process of controlling the swing electric motor 25. The control process in FIG. 9 is repeated for each control period of the controller 80.

Figure 10:
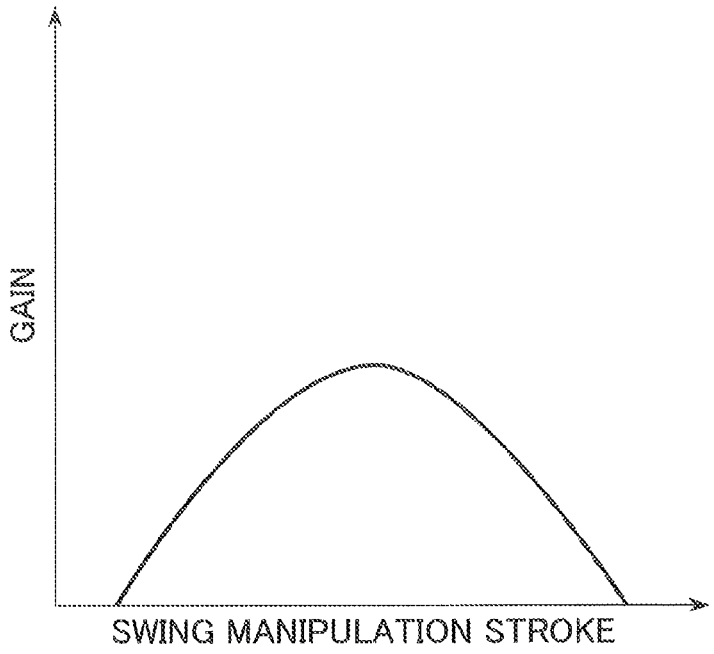
FIG. 10 is a diagram showing an example of a driving gain table used for control of the swing electric motor.

First, in step S10 the torque of the swing hydraulic motor 27 is calculated from a differential pressure between the A-port and the B-port, the pressure having been detected across the motor by a pressure sensor not shown. Next, in step S11 it is determined whether the swing hydraulic motor 27 is generating a driving torque or braking torque using the hydraulic motor torque. For example, if the A-port pressure is higher than the B-port pressure and the rotating direction of the motor is developing a leftward swing, the motor is determined to be generating a driving torque. In the case that the swing hydraulic motor 27 is determined in this step to be generating a driving torque, a swing electric motor torque command value T1 is calculated in step S12 using a driving gain table. This driving gain table includes, for example, a driving gain level determined according to the particular manipulation stroke of the swing lever, as shown in FIG. 10, and the driving gain level is based upon the bleed-off opening area characteristics of the swing spool 44 that are shown in FIG. 4. The bleed-off opening area shown in FIG. 4 is set so that when the swing control lever 72 is in the intermediate region, the driving torque of the swing hydraulic motor is small relative to the swing hydraulic motor driving torque as used for driving a swing with the hydraulic motor alone. In addition, as shown in FIG. 10, the driving gain is set to be maximal when the swing control lever 72 is in the intermediate region. In step S12, a value derived by multiplying the driving gain determined using the driving gain table, by the hydraulic motor torque described above, is obtained as the swing electric motor torque command value T1.

Figure 11:
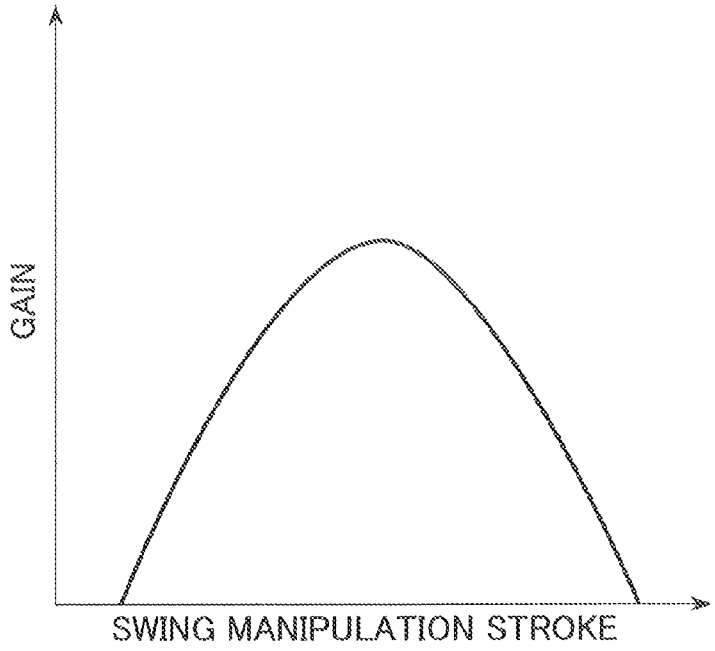
FIG. 11 is a diagram showing an example of a braking gain table used for the control of the swing electric motor.

Conversely if the determination result in step S11 is negative and the swing hydraulic motor 27 is determined to be generating a braking torque, the swing electric motor torque command value T1 is calculated in step S13 using a braking gain table. This braking gain table includes, for example, a braking gain level determined according to the particular manipulation stroke of the swing lever, as shown in FIG. 11, and the braking gain level is based upon the meter-out opening area characteristics of the swing spool 44 that are shown in FIG. 5. The meter-out opening area shown in FIG. 5 is set so that when the swing control lever 72 is in the intermediate region, the braking torque of the swing hydraulic motor is small relative to the swing hydraulic motor braking torque as used for driving a swing with the hydraulic motor alone. In addition, as shown in FIG. 11, the braking gain is set to be maximal when the swing control lever 72 is in the intermediate region. A value derived by multiplying the braking gain determined from the braking gain table, by the hydraulic motor torque, is obtained as the swing electric motor torque command value T1.

As described above, the swing electric motor torque command value T1 is a command value that allows for the swing lever manipulation stroke and the hydraulic motor torque. A situation of a desired swing electric motor torque being unobtainable by reason of, for example, changes in swing hydraulic motor torque due to factors such as an orientation of a front section of the construction machine, load, and the amount of manipulation of the swing control lever, can be avoided by braking/driving the swing electric motor on the basis of the swing electric motor torque command value T1. Accordingly in the composite swing mode, which uses both of the swing hydraulic motor and the swing electric motor to conduct braking/driving, the torque matching the manipulation stroke of the swing control lever can be obtained. This in turn allows an operator to operate the swing body at a desired positive/negative acceleration rate according to the particular manipulation stroke of the swing control lever, and hence to obtain high operability.

In the present invention, since driving a swing using only energy recovered during braking leads to improving electric devices in efficiency, the machine is preferably designed so that braking energy is greater than driving energy. The driving gain table and braking gain table described above, therefore, are preferably set so that the braking gain is greater for the same manipulation stroke of the swing control lever.

Next, it is determined in step S14 whether the relief pressure of the A-port has been reduced per the control process diagram of FIG. 7 and whether the A-port pressure is higher than the previously set threshold level P2. If these conditions are met, a value TR that makes the swing electric motor develop a decrement in the torque of the swing hydraulic motor due to the reduction in the relief pressure of the A-port is set in step S15 as an electric motor torque command value T2, that is, torque command value T2=TR.

Conversely, in above determination step S14 of whether the relief pressure of the A-port has been reduced and whether the A-port pressure is higher than the previously set threshold level P2, if the conditions are not met, it is determined in step S16 whether the relief pressure of the B-port has been reduced per the control process diagram of FIG. 8 and whether the B-port pressure is higher than the previously set threshold level P2. If these conditions are met, then similarly to the above, a value TR that makes the swing electric motor develop a decrement in the torque of the swing hydraulic motor due to the reduction in the relief pressure of the B-port is set equal to electric motor torque command value T2, that is, torque command value T2=TR. The torque command value T2=TR is a torque command value that compensates for the reduction in the torque of the swing hydraulic motor due to the reduction from the normal predetermined relief pressure of the swing hydraulic motor during the control of the A-port relief valve 28 and the B-port relief valve 29. For example, TR is a value calculated from the decrement in relief pressure and a volume of the hydraulic motor.

Conversely, in above determination step S16 of whether the relief pressure of the B-port has been reduced and whether the B-port pressure is higher than the previously set threshold level P2, if the conditions are not met, electric motor torque T2=0 is set in step S17.

The threshold level P2 here is slightly lower, for example several MPa lower, than a normal setting of a relief pressure, and if there is a decrease in the relief pressure of the port, the port pressure at a given time is compared with P2, whereby it is determined whether the control of the relief pressure is in progress.

Next, in step S18, magnitudes of the swing electric motor torque command values T1 and T2 determined above are compared and the greater electric motor torque command value is selected as a torque command value for the swing electric motor 25. This torque command value is then used to control the power control unit 55 so that the swing electric motor generates a torque equivalent to the reduction in swing hydraulic motor torque. Thus, the torque matching the manipulation stroke of the swing control lever can be obtained as the total torque of the swing hydraulic motor 27 and the swing electric motor 25. This leads to allowing the operator to obtain for the swing body the desired torque matching the manipulation stroke of the swing control lever, and hence to obtain high operability.

In addition, as described above, the present embodiment provides the hydraulic motor independent swing mode in which the swing body is braked/driven with the swing hydraulic motor alone when the swing control lever is in the neutral position or the maximum stroke position, and the composite swing mode in which the swing body is braked/driven with the total torque of the swing hydraulic motor and the swing electric motor when the swing control lever is in the intermediate position. In addition, one of these operation modes can be selectively used, depending upon the desired manipulation stroke of the swing lever. If the desired torque matching the manipulation stroke of the swing lever cannot be obtained in the composite swing mode, therefore, the positive/negative acceleration of the swing body that occurs according to the particular manipulation stroke of the swing lever is likely to differ between the modes. If this difference in positive/negative acceleration actually occurs, the operator will have a feeling of operational discomfort or uneasiness. In order to avoid this, the swing electric motor is braked/driven using the swing electric motor torque command value that has been calculated in the present embodiment, and thus the total torque of the swing hydraulic motor and swing electric motor that matches the manipulation stroke of the swing lever can be obtained. This in turn alleviates the difference in the positive/negative acceleration of the swing body between the operation modes, hence mitigating the operator's feeling of discomfort or uneasiness due to the difference in the positive/negative acceleration, and providing high operability.

In addition, if as in the present embodiment, a swing electric motor is braked/driven using either torque command value previously calculated for the swing electric motor, an operator familiar with operations on a construction machine, such as a hydraulic excavator, that brakes/drives a swing body with a hydraulic motor alone, can also operate the machine according to the particular manipulation stroke of a swing control lever, without having a feeling of discomfort or uneasiness due to any differences in positive/negative acceleration of the swing body.

During the calculation of the swing electric motor torque command values, after selection of the torque command value T1 or T2, whichever is the greater, in step S18, the selected torque command value may be limited in step S19 to prevent the total torque of the swing hydraulic motor 27 and the swing electric motor 25 from exceeding the torque of the hydraulic motor of a conventional machine, and thus to avoid overloading of the swing mechanism 26. Alternatively or additionally, the torque command value may have its rate of change limited to avoid imparting to the operator a feeling of discomfort or uneasiness due to an abrupt change in the torque of the swing electric motor 25. Furthermore, when the swing electric motor 25 is generating a driving torque, controlling a volume of the hydraulic pump 41 for a reduction in power of the pump according to power equivalent to that torque allows a load of the engine to be reduced.

Second Embodiment

Figure 12:
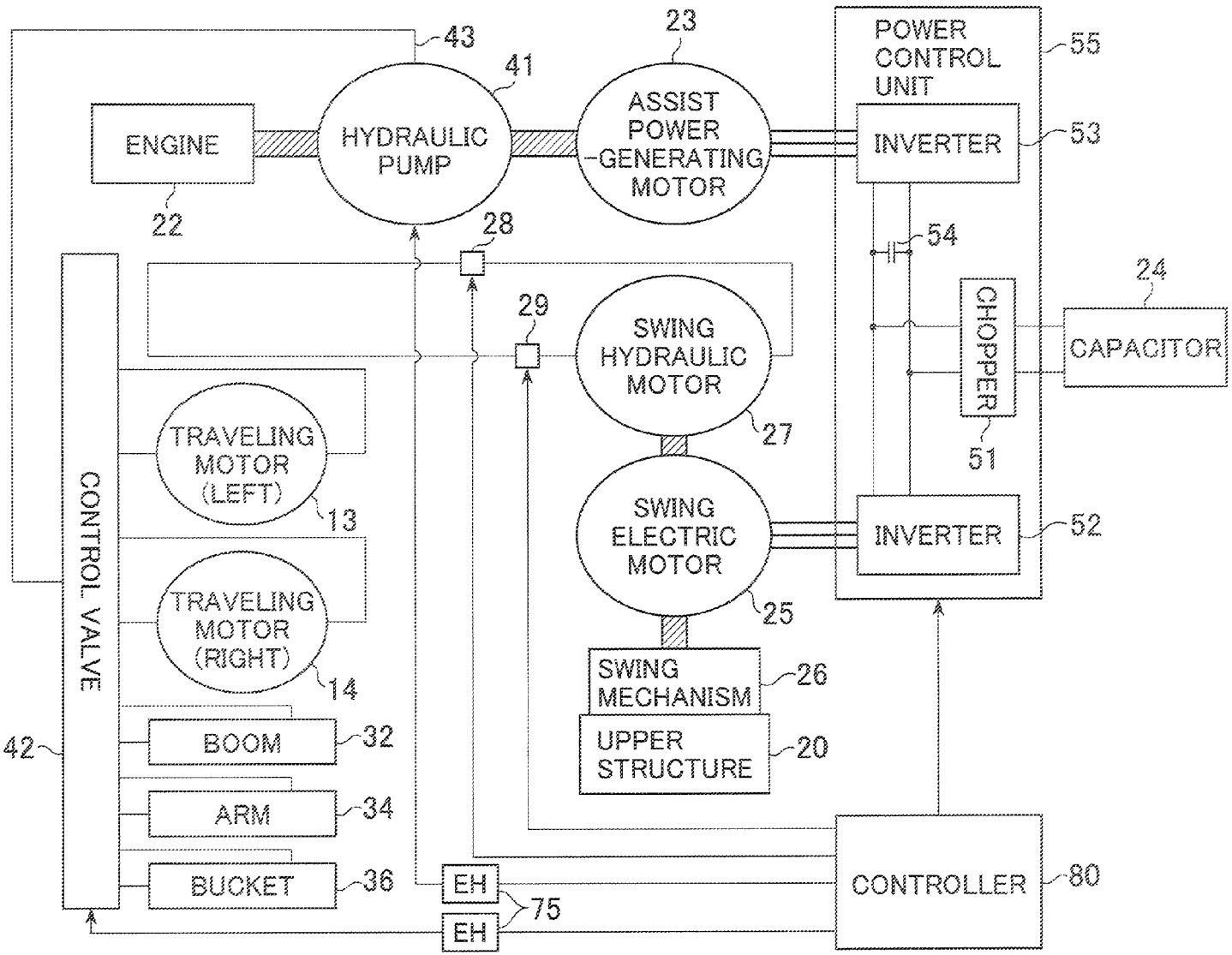
FIG. 12 is a system block diagram of a hydraulic excavator according to a second embodiment of the present invention.

FIG. 12 shows a system block diagram of main electric/hydraulic devices in a hydraulic excavator according to a second embodiment of the present invention. In the first embodiment, the bleed-off and meter-out opening areas of the control valve 42 have been increased above those of a conventional machine to reduce the driving and braking torques of the swing hydraulic motor 27 below those of the conventional machine. Instead of or in combination with this measure, the driving and braking torques of the swing hydraulic motor 27 may be reduced below those of the conventional machine by controlling the spool stroke of the control valve 42 by use of the controller 80.

Figure 13:
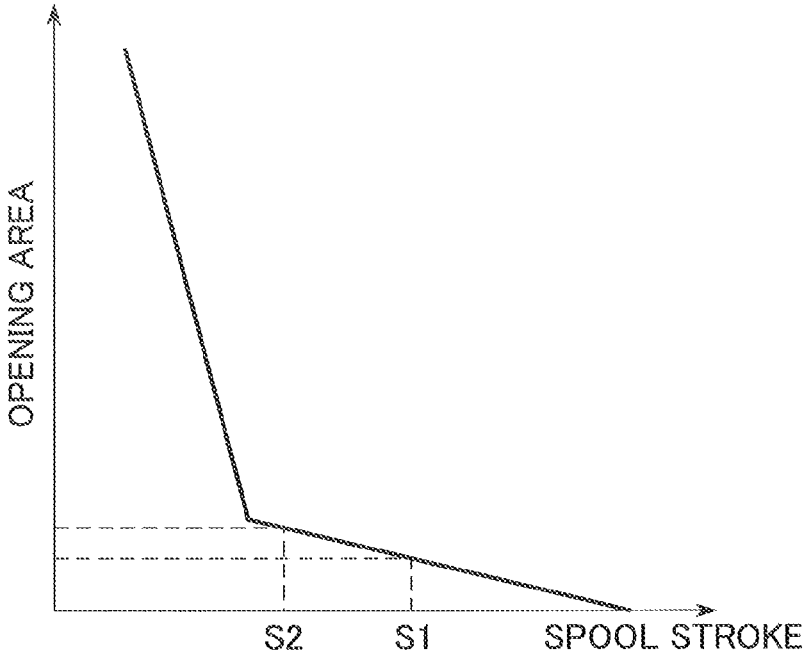
FIG. 13 is a bleed-off opening area diagram of a swing spool in the second embodiment.
Figure 14:
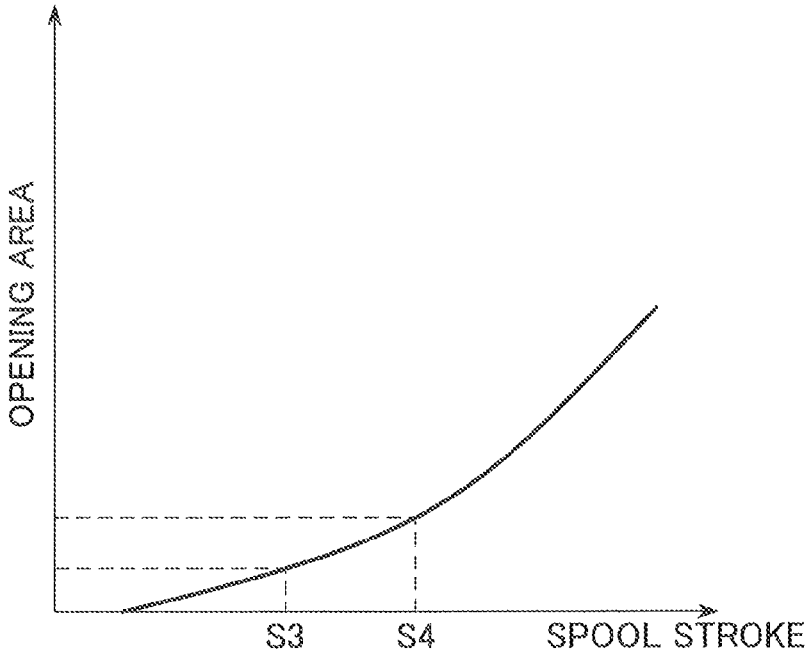
FIG. 14 is a meter-out opening area diagram of the swing spool in the second embodiment.

For example, if during the driving of the swing body, the spool stroke matching a predetermined amount of manipulation in the conventional construction machine is S1 as shown in FIG. 13, the present embodiment controls the spool stroke to be S2. This increases the bleed-off opening area and reduces the driving torque of the swing hydraulic motor 27. Additionally, if during the braking of the swing body, the spool stroke matching a predetermined amount of manipulation in the conventional construction machine is S3 as shown in FIG. 14, the present embodiment controls the spool stroke to be S4. This increases the meter-out opening area and reduces the braking torque of the swing hydraulic motor 27. Controlling the swing electric motor 25 to generate a torque equivalent to the decrease in the braking/driving torque of the swing hydraulic motor 27 yields substantially the same advantageous effects as those achieved in the present embodiment.

The present invention can be applied to practically any type of working/construction machine equipped with a swing body, and the application of the invention is neither limited to hydraulic excavators, nor requires a machine configuration in which the machine has a hydraulic motor/electric motor composite swing mode and a hydraulic motor independent swing mode and selectively uses either mode, depending upon requirements of the operator.

DESCRIPTION OF REFERENCE NUMERALS

10 Lower structure
11 Crawler
12 Crawler frame
13 Traveling hydraulic motor (Right)
14 Traveling hydraulic motor (Left)
20 Swing body
21 Swing frame
22 Engine
23 Assist power-generating motor
24 Capacitor
25 Swing electric motor
26 Swing mechanism
27 Swing hydraulic motor
28 A-port relief valve
29 B-port relief valve
30 Excavator mechanism
31 Boom
32 Boom cylinder
33 Arm
34 Arm cylinder
35 Bucket
36 Bucket cylinder
40 Hydraulic system
41 Hydraulic pump
42 Control valve
43 Hydraulic line
44 Swing spool
51 Chopper
52 Inverter for swing electric motor
53 Inverter for assist power-generating motor
54 Smoothing capacitor
55 Power control unit
72 Swing control lever
75 Electro-hydraulic signal conversion device
80 Controller

The invention claimed is:

1. A construction machine comprising:

a swing hydraulic motor driven by an oil pressure that a hydraulic pump generates when driven by an engine;

a swing electric motor connected to the swing hydraulic motor and driven by electric power that an electricity storage device supplies; and a swing body connected to the swing electric motor, the machine braking/driving the swing electric motor and the swing hydraulic motor according to a manipulation stroke of a swing control lever which operates the swing body, and thereby braking/driving the swing body by use of a total torque of the swing electric motor and the swing hydraulic motor;

wherein an electric motor torque command value that is input to the swing electric motor to brake/drive the swing electric motor, is calculated by correcting a torque of the swing hydraulic motor according to the manipulation stroke of the swing control lever; and wherein the electric motor torque command value is calculated by multiplying the torque of the swing hydraulic motor by a gain which is set according to the manipulation stroke of the swing control lever.

2. The construction machine according to claim 1, further comprising:

a swing spool that controls a delivery rate and delivery direction of a hydraulic fluid to the swing hydraulic motor according to the manipulation stroke of the swing control lever;

wherein the gain is determined by an opening area of the swing spool that is set according to the manipulation stroke of the swing control lever.

3. The construction machine according to claim 1, configured to:

compare the electric motor torque command value and an electric motor torque command value calculated from a relief pressure of the swing hydraulic motor, and input a greater of the electric motor torque command values to the swing electric motor.

4. The construction machine according to claim 1, further comprising:

a relief valve that changes a relief pressure, the relief valve being disposed between the hydraulic pump and the swing hydraulic motor;

wherein, if an absolute rotating speed of the swing electric motor exceeds a first rotating speed or the manipulation stroke of the swing control lever exceeds a first manipulation stroke, the swing hydraulic motor is reduced in relief pressure, and after this, if either the absolute rotating speed of the swing electric motor decreases below a second rotating speed setting lower than the first rotating speed, or the manipulation stroke of the swing control lever decreases below a second manipulation stroke setting lower than the first manipulation stroke, the reduced relief pressure of the swing hydraulic motor is raised.

5. The construction machine according to claim 4, wherein:

if the relief pressure of the swing hydraulic motor is reduced and a pressure thereof is in excess of a second pressure, an electric motor torque command value is calculated that makes the swing electric motor generate a decrement in the torque of the swing hydraulic motor due to the reduction in the relief pressure thereof.

6. The construction machine according to claim 1, configured to:

when the swing electric motor is generating a driving torque, reduce power of the hydraulic pump, or a rate at which the pump conducts work per unit time.

7. The construction machine according to claim 1, configured to:

limit a torque command value so that a braking/driving torque obtained as the total torque of the swing electric motor and the swing hydraulic motor will stay within a predetermined range.

8. The construction machine according to claim 1, configured to:

limit a change rate of a torque command value so that a change rate of a braking/driving torque of the swing electric motor stays within a predetermined range.

* * * * *